US006383366B1

(12) United States Patent
Riley et al.

(10) Patent No.: US 6,383,366 B1
(45) Date of Patent: May 7, 2002

(54) WAX HYDROISOMERIZATION PROCESS

(75) Inventors: Kenneth Lloyd Riley; William John Murphy; Ian Alfred Cody, all of Baton Rouge, LA (US); Stuart Leon Soled, Pittstown, NJ (US); Gary Brice McVicker, Califon, NJ (US); Sabato Miseo, Pittstown, NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/601,858

(22) PCT Filed: Feb. 12, 1998

(86) PCT No.: PCT/US99/03010

§ 371 Date: Nov. 14, 2000

§ 102(e) Date: Nov. 14, 2000

(87) PCT Pub. No.: WO99/41337

PCT Pub. Date: Aug. 19, 1999

Related U.S. Application Data

(60) Provisional application No. 60/074,691, filed on Feb. 13, 1998.

(51) Int. Cl.[7] ..... C10G 35/085

(52) U.S. Cl. ..... 208/137; 208/18; 208/134; 208/135; 208/96; 208/66; 585/310; 585/734; 585/739

(58) Field of Search ..... 208/18, 134, 135, 208/137, 66, 96; 585/310, 734, 739

(56) References Cited

U.S. PATENT DOCUMENTS

| | | | | |
|---|---|---|---|---|
| 4,678,556 A | | 7/1987 | Hicks et al. | 208/96 |
| 4,943,672 A | | 7/1990 | Hamner et al. | 585/737 |
| 4,975,177 A | | 12/1990 | Garwood et al. | 208/27 |
| 5,059,299 A | | 10/1991 | Cody et al. | 208/27 |
| 5,273,949 A | * | 12/1993 | Chopin et al. | 502/238 |
| 5,378,351 A | | 1/1995 | Guichard et al. | 208/143 |
| 5,723,716 A | | 3/1998 | Brandes et al. | 585/734 |
| 5,834,522 A | | 11/1998 | Mignard et al. | 518/700 |
| 5,885,438 A | | 3/1999 | Apelian et al. | 208/27 |
| 6,106,802 A | * | 8/2000 | Lujano et al. | 423/702 |

FOREIGN PATENT DOCUMENTS

| | | | |
|---|---|---|---|
| WO | WO9941337 | 8/1999 | C10G/71/00 |

* cited by examiner

*Primary Examiner*—Nadine Preisch
(74) *Attorney, Agent, or Firm*—Linda M. Scuorzo; James H. Takemoto

(57) ABSTRACT

Waxy feeds are treated under hydroisomerization conditions to produce good yields of an isomerate product of high VI by using a silica-alumina based catalyst in which the silica-alumina has a pore volume less of 0.99 ml/gm ($H_2O$), an alumina content in the range of 35 to 55 wt % and an isoelectric point in the range of 4.5 to 6.5. A lube fraction of the isomerate is dewaxed to provide a lube basestock of high VI. The silica-alumina may be modified with a rare earth oxide or yttria or boria or magnesia in which instance the modified catalyst has an isoelectric point greater than but no more than 2 points greater than base the silica-alumina.

10 Claims, 3 Drawing Sheets

ISOELECTRIC POINT FOR SILICA ALUMINA'S
Catalyst A
Catalyst B
iso electric point
9.0
8.0
7.0
6.0
5.0
4.0
3.0
2.0
0.0
20.0
40.0
60.0
80.0
100.0
120.0
alumina content, wt%

ISOELECTRIC POINT FOR YTTRIA / SILICA ALUMINA'S

O = CARBON ATOMS NEAR BRANCHES / ENDS
1-8 = FREE CARBON ATOMS

FCI ( OF STRUCTURE A ) =((8/26)x100)x(26/100) = 8

WAX HYDROISOMERIZATION PROCESS

This appln is a 371 of PCT/US99/03010 filed Feb. 12, 2000, which claims benefit of Prov. No. 60/074,691 filed Feb. 13, 1998.

FIELD OF THE INVENTION

This invention relates to the hydroisomerization of waxy feeds including slack wax, Fischer-Tropsch wax, waxy raffinates, and waxy distillates to produce in a good yield a lube oil basestock or blending stock having a high viscosity index (VI).

BACKGROUND OF THE INVENTION

The performance criteria for lubricants such as those used in automatic transmission fluids and passenger car engine oils has become increasingly more severe and is expected to become even more so in the future. Indeed, it is expected that additive technology will be insufficient to meet future lubricant performance criteria. Thus, improved base oils will be needed.

It is generally accepted that formulators of automatic transmission fluids and passenger car engine oils will need lube oil basestocks that have a high viscosity index (VI) and a low paraffinic wax content.

Isomerization of wax and waxy feeds to liquid products boiling in the lube boiling range is a practice well-known in the art. Catalysts useful in such processes comprise Group VIII metals on refractory oxide support such as silica-alumina and acidic refractory metal oxide supports such as fluorided alumina. Catalysts using silica-alumina supports are known to produce isomerates with good viscosity index; however, these materials traditionally exhibit poor selectivity for wax disappearance into isomerate product with the result that the yields of the isomerate lube are low. In the case of catalyst supported by halogenated aluminas such as fluorided alumina high VI isomerates are produced; however, the activity of these catalysts is low thereby requiring higher temperatures and pressures to process the feed which is generally undesirable. As a consequence, there remains a need for catalysts and processes which will produce good yields of lube basestocks with high VI.

SUMMARY OF THE INVENTION

This invention relates to a method of producing a lube oil feedstock from a waxy feed which comprises: contacting the waxy feed with an isomerization catalyst under catalytic isomerization conditions wherein the isomerization catalyst comprises a metal hydrogenation component and a silica-alumina support, said silica-alumina having a pore volume of less than 0.99 ml/gm ($H_2O$), an alumina content of between about 35 to 55 wt % based on silica-alumina and an isoelectric point of from 4.5 to 6.5 to provide a lube feedstock; and thereafter solvent dewaxing at least a portion of the feedstock.

This and other embodiments of the invention will be discussed below.

DESCRIPTION OF THE INVENTION

Figure 1:
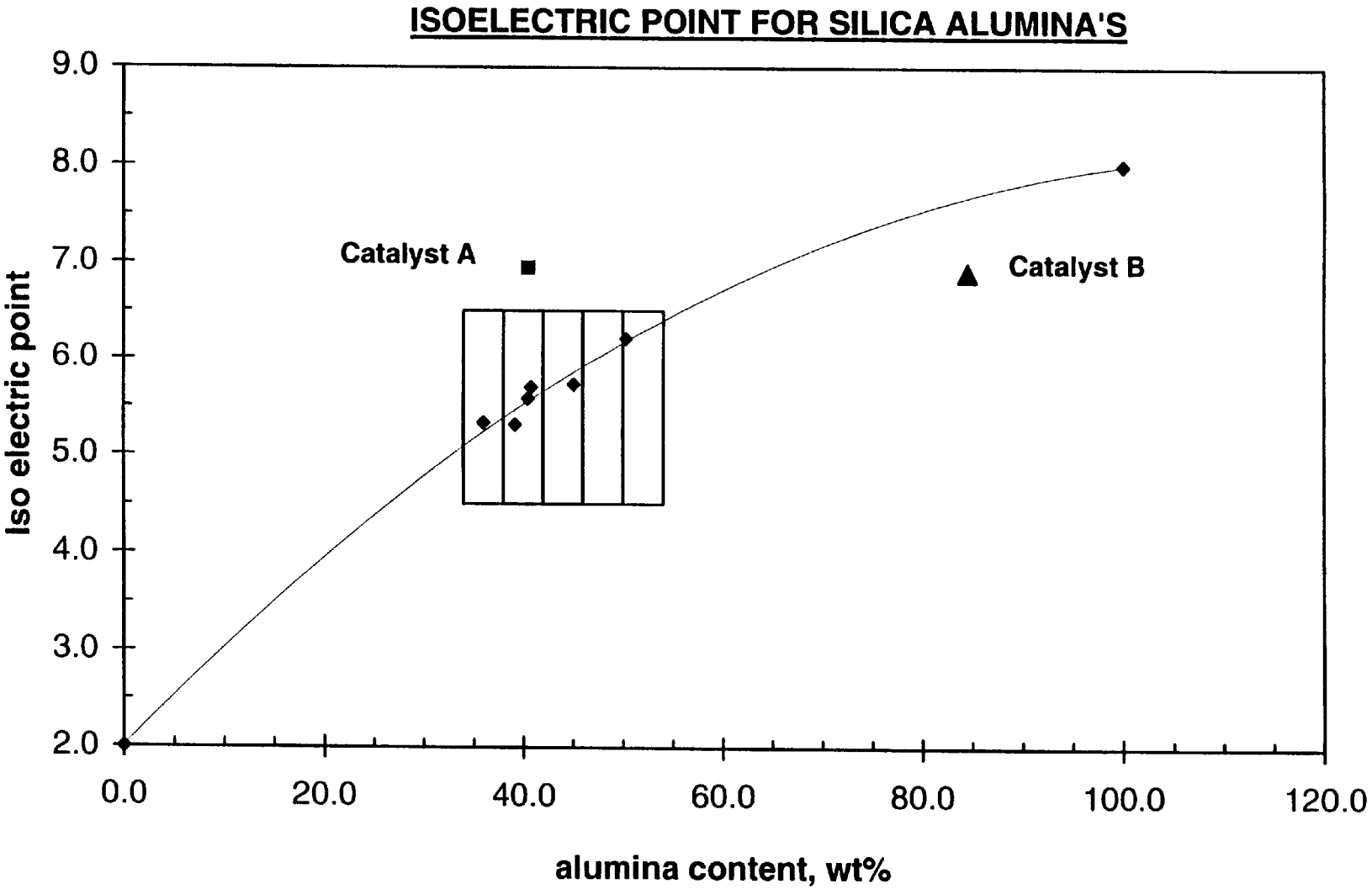
FIG. 1 is a plot of IEP versus alumina content.

The feed suitable in the practice of the present invention includes waxy hydrocarbon oils such as slack wax, Fischer-Tropsch wax, waxy raffinates and waxy distillates. Typically, such feeds will have wax contents of 15 wt % or more. The preferred feed will have a nitrogen and sulfur content each below about 20 ppm by weight Indeed, if the feed contains higher amounts of sulfur and nitrogen, the feed can be first subjected to hydrotreating under typical hydrotreating conditions to reduce the sulfur and nitrogen contents. Any of the conventional hydrotreating catalysts can be employed like Ni/Mo on alumina, Ni/W on alumina and Co/Mo on alumina. In other words any of the Group VIB to Group VIII metals of the Periodic Table of Elements (Sargent-Welch Scientific Co.) on metal oxide refractory supports may be employed. Commercial examples of such are identified as HDN-30 and KF-840.

Hydrotreating is conducted so as to lower the sulfur and nitrogen contents to levels of 20 ppm or less nitrogen or 20 ppm or less sulfa especially 10 ppm less nitrogen and 10 ppm or less sulfur and most preferably to levels below 5 ppm for nitrogen and 5 ppm or less for sulfur.

Waxy feeds secured from natural petroleum sources contain quantities of sulfur and nitrogen compounds which are known to deactivate wax hydroisomerization catalysts. To prevent this deactivation it is preferred that the feed contain no more than 10 ppm sulfur, preferably less than 2 ppm sulfur and no more than 2 ppm nitrogen, preferably less than 1 ppm nitrogen.

To achieve these limits the feed is preferably hydrotreated to reduce the sulfur and nitrogen content.

Hydrotreating can be conducted using any typical hydrotreating catalyst such as Ni/Mo on alumina, Co/Mo on alumina, Co/Ni/Mo on alumina, e.g., KF-840, KF-843, HDN-30, HDN-60, Criteria C-411, etc. Similarly, bulk catalysts comprising Ni/Mo or Cr/Ni/Mo sulfides as described in U.S. Pat. No. 5,122,258 can be used.

Hydrotreating is performed at temperatures in the range 280° C. to 400° C., preferably 340° C. to 380° C. at pressures in the range 500 to 3000 psi, hydrogen treat gas rate in the range of 500 to 5000 SCF/bbl and a flow velocity in the range 0.1 to 5 LHSV, preferably 1 to 2 LHSV.

The hydrotreated waxy oil is stripped to remove ammonia and $H_2S$ and then is subjected to the hydroisomerization process of the present invention.

The catalyst employed in the hydroisomerization of waxy feeds in accordance with the present invention is a silica-alumina based catalysts having a pore volume less than 0.99 ml/gm ($H_2O$) preferably less than 0.8 ml/gm ($H_2O$) and most preferably less than 0.6 ml/gm ($H_2O$). As is known in the art, the term "pore volume ($H_2O$)" refers to pore volume measured by drying the catalyst to about 500° C.; weighing the dried catalyst; immersing it in water for 15 minutes; removing the material from the water and centrifuging to remove surface water. Then the material is weighed and the pore volume is determined from the differences in weight between the dried catalyst and the latter material.

In addition to its pore volume, the silica-alumina support of the catalyst is further characterized as having an alumina content in the range of 35 to 55 wt %, preferably from 35 to 50 wt %, and most preferably 38 to 45 wt %, based on silica-alumina.

Another criteria of the silica-alumina used in the catalyst of the present invention is that it has an isoelectric point equal to or greater than 4.5 and equal to or less than 6.5 as illustrated in FIG. 1. The blackened diamonds falling within the boxed area exemplify catalysts of the invention. The blackened box, blackened triangle and two endpoint blackened diamonds indicate materials falling outside the present invention. As is known in the art the isoelectric point of a material depends upon the relative concentration and the acidity ($pK_a/pK_b$) of surface species (Parks, G. A., *Chem. Review,* 177–198 (1965)).

The catalyst of the present invention also contains a metal hydrogenation component which is at least one of a Group VIB and Group VIII metal and preferably a Group VIII metal, more preferably platinum, palladium, and mixtures thereof. The amount of metal component is from 0.1 to 30 wt % based on catalyst, preferably 0.3 to 10 wt %. If the metal is Pt or Pd, the preferred amount is from 0.1 to 5 wt %.

Figure 2:
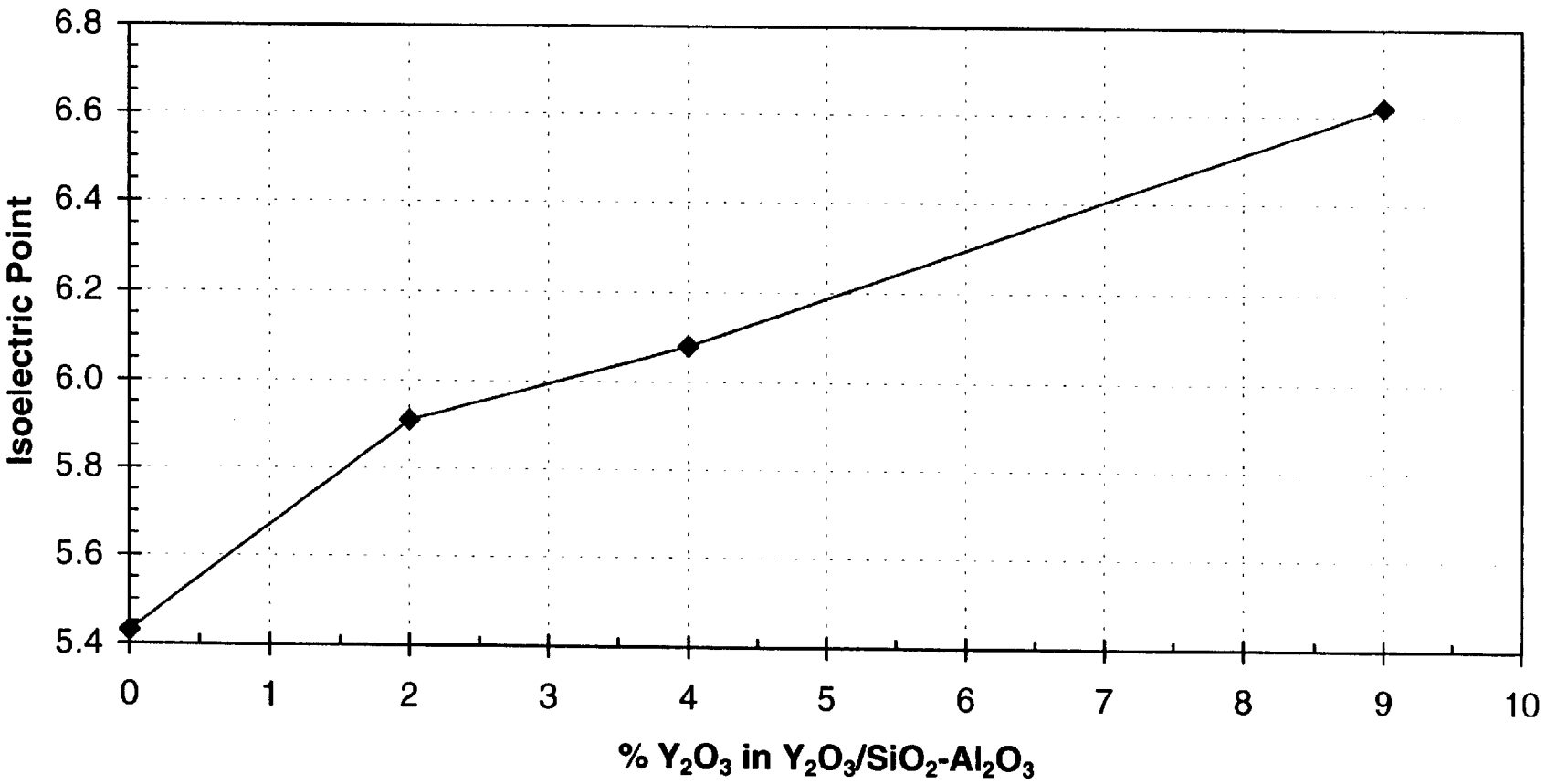
FIG. 2 is a plot of IEP versus % $Y_2O_3$ in $Y_2O_3/SiO_2$—$Al_2O_3$.

Optionally the silica-alumina based catalyst material can be promoted or doped with, e.g., yttria or with a rare earth oxide, e.g., La, Ce, etc., or with, e.g., boria, magnesia. In this particular embodiment, the isoelectric point will increase depending on the dopant and dopant level as shown in FIG. 2.

In the present invention hydroisomerization is conducted in the presence of the catalyst at a temperature between about 250° C. to 400° C., preferably at 300° C. to about 380° C., at pressure between about 500 to 3000 psig (3.55 to 20.8 mPa) and preferably about 1000 to 1500 psig (7.0 to 10.4 mPa), a hydrogen gas treat rate of 1000 to 10,000 $SCFH_2/B$ (178 to 1780 $m^3/m^3$) and preferably about 1000 to 2500 $SCFH_2/B$ (178 to 445 $m^3/m^3$) and a LHSV of 0.1 to 10 v/v/hr preferably 1 to 2 v/v/hr for a time sufficient to convert at least 10% of the feed to 370° C. isomerate.

Following isomerization the isomerate is fractionated into a lubes cut and fuels cut. The lubes cut is that fraction boiling in the 330° C.+ range and preferably the 350° C.+ range or even higher.

After separating the lubes fraction, the lube fraction is then subjected to a dewaxing step. Dewaxing can be achieved under solvent dewaxing conditions. The lube fraction is dewaxed, preferably to a pour point of about −20° C. or lower. Preferably the unconverted wax is recovered and is recycled. Thus a separate stripper can be used to remove entrained dewaxing solvent or other contaminants.

Solvent dewaxing utilizes typical dewaxing solvents such as $C_3$–$C_6$ ketones (e.g., methyl ethyl ketone, methyl isobutyl ketone and mixtures thereof). $C_6$–$C_{10}$ aromatic hydrocarbons (e.g., toluene), mixtures of ketones and aromatics (e.g., MEK/toluene), autorefrigerative solvents such as liquefied, normally gaseous $C_2$–$C_4$ hydrocarbons such as propane, propylene, butane, butylene, etc., at filter temperature of −25° C. to −30° C. It has been discovered that the preferred solvent to dewax the isomerate under miscible conditions and thereby produce the highest yield of dewaxed oil at a high filter rate is a mixture of MEK/MIBK (v/v) used at a temperature in the range of −25° to −30° C. Pour points lower than −21° C. can be achieved using lower filter temperatures and other ratios of said solvent. Further, when dewaxing isomerate made from a microwax, e.g., Bright Stock slack wax, it has been found to be preferred that the fraction of the isomerate which is dewaxed is the "broad heart cut" identified as the fraction boiling between about 330° C. to 600° C. When processing wax fractions higher than 1050° F.+ (565.56° C.) the heavy bottoms fraction contains appreciable unconverted wax so they can be recycled to the hydrotreating unit.

It has also been found that prior to fractionation of the isomerate into various cuts and dewaxing said cuts, the total liquid product (TLP) from the isomerization unit can be advantageously treated in a second stage at mild conditions using the isomerization catalyst or a noble Group VIII on refractory metal oxide catalyst to reduce PNA and other contaminants in the isomerate and thus yield an oil of improved daylight stability.

In that embodiment, the total liquid product is passed over a charge of the isomerization catalyst or over noble Group VIII on, e.g., a temperature in the range of about 170° C. to 270° C., preferably about 180° C. to 220° C. at a pressure of about 300 to 1500 psig $H_2$ (2.17 to 10.4 mPa) preferably about 500 to 1000 psig $H_2$ (3.55 to 7.0 mPa), a hydrogen gas rate of about 500 to 10,000 SCF/B (89 to 1780 $m^3/m^3$), preferably 1000 to 5000 SCF/B (178 to 890 $m^3/m^3$) and a flow velocity of about 0.25 to 10 v/v/hr preferably about 1 to 4 v/v/hr.

The total liquid product can be treated under these mild conditions in a separate, dedicated unit or the TLP from the isomerization reactor can be stored in tankage and subsequently passed through the isomerization reactor under said mild conditions. It has been found to be unnecessary to fractionate the total liquid product prior to this mild second stage treatment. Subjecting the whole TLP to this mild second stage treatment produces an oil product, which upon subsequent fractionation and dewaxing yields a base oil exhibiting a high level of daylight stability and oxidation stability.

The resultant basestock of the process of the present invention comprises at least about 75 wt % of isoparaffins but has a unique structural character. Basically, the basestock has a "Free Carbon Index" (or FCI) typically in the range of 4 to 12, preferably less than 10. The term "Free Carbon Index" is a measure of the number of carbons in an iso-paraffin that are located at least 3 carbons from a terminal carbon and more than 3 carbons away from a side chain. The FCI of an isoparaffin can be determined by measuring the percent of methylene groups in an isoparaffin sample using $^{13}C$ NMR (400 megahertz); multiplying the resultant percentages by the calculated average carbon number of the sample determined by ASTM Test method 2502 and dividing by 100. A further criterion, which differentiates these materials structurally from poly alpha olefins, is the branch length. Interestingly, in the basestocks of this invention, at least 75% of the branches, as determined by NMR, are methyl's and the population of ethyl, propyl and butyls, etc., fall sharply with increasing molecular weight to the point where no more than 5% are butyls. Typically the ratio of "free carbons" to end methyl is in the range of 2.5 to 4.0. Additionally, the basestocks of this invention typically have, on average, from 2.5 to 4.5 side chains per molecule.

In contrast, polyalpha-olefin (PAO) basestocks have fewer (about one) and longer branches or side-chains. Indeed the ratio of "free carbons" to end methyl ranges from 1.1 to 1.7.

The FCI is further explained as follows. The basestock is analyzed by $^{13}C$ NMR using a 400 MHz spectrometer. All normal paraffins with carbon numbers greater than $C_9$ have only five non-equivalent NMR adsorptions corresponding to the terminal methyl carbons ($\alpha$) methylenes from the second, third and forth positions from the molecular ends ($\beta$, $\gamma$ and $\delta$ respectively), and the other carbon atoms along the backbone which have a common chemical shift ($\epsilon$). The intensities of the $\alpha$, $\beta$, $\gamma$ and $\delta$ are equal and the intensity of the $\epsilon$ depends on the length of the molecule. Similarly the side branches on the backbone of an isoparaffin have unique chemical shifts and the presence of a side chain causes a unique shift at the tertiary carbon (branch point) on the backbone to which it is anchored. Further, it also perturbs the chemical sites within three carbons from this branch point imparting unique chemical shifts (α', β', and γ').

Figure 3:
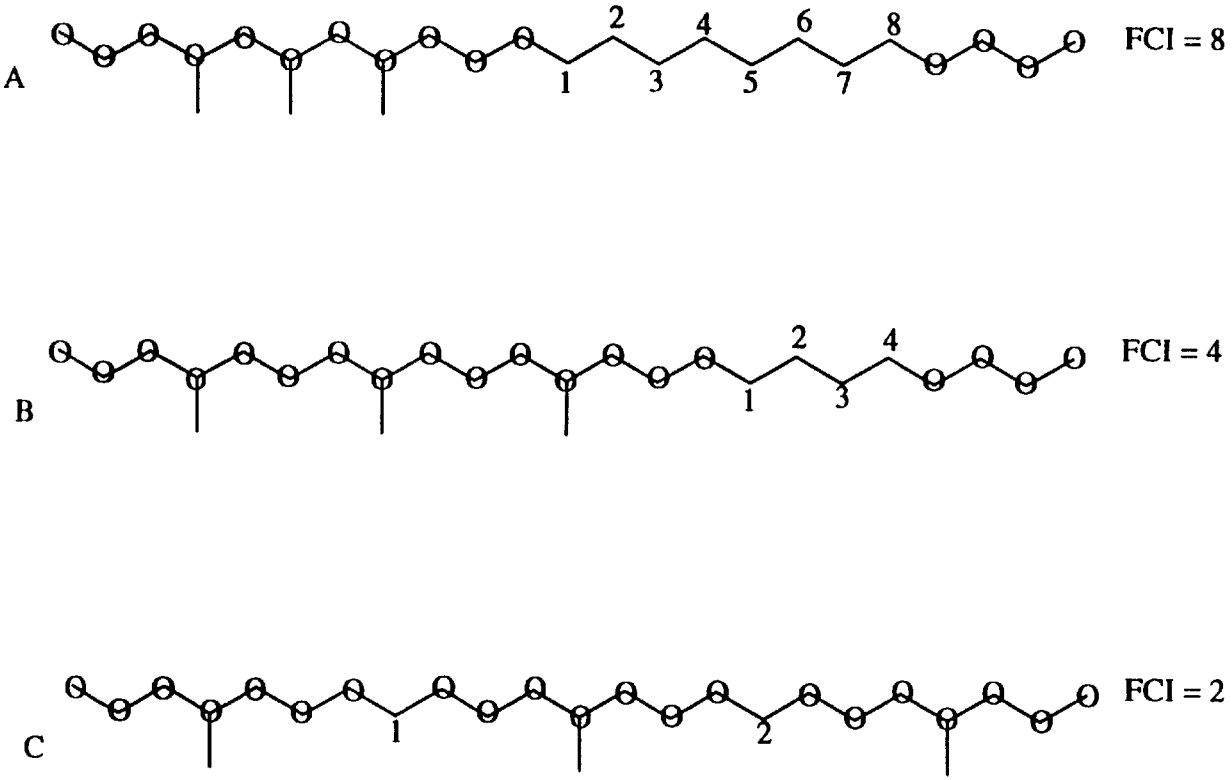
FIG. 3 is a schematic representation of three isoparaffins each having a different Free Carbon Index (for A FCI=8; B FCI=4; C FCI=2).

The Free Carbon Index (FCI) is then the percent of ϵ methylenes measured from the overall carbon species in the $^{13}C$ NMR spectra of the a basestock, divided by the average carbon Number of the basestock as calculated from ASTM method 2502, divided by 100. This is further illustrated in FIG. 3 which shows the FCI for three compounds having FCI's ranging from 8 to 2 (A=8; B=4; C=2). In FIG. 3, O=carbon atoms near branches/ends; 1–8=free carbon atoms. Thus, e.g., the FCI of A is calculated as ((8/26)×100)×(26/100)=8.

Even after very low conversion levels (<10%), the value of ϵ falls by nearly 50% and there is a large increase in the side chain fraction, larger in fact than that observed in a product that has been severely isomerized (>70% conversion to 370° C.–) and solvent dewaxed. The increase in sidechains is almost exclusively in methyl sidechains. There is a much larger percentage of terminal end groups and the distinction between a methyl at the second or third carbons from the end drops significantly. Roughly 35% of the added sidechains have been added to the last four terminal carbons.

The following examples serve to illustrate, but not limit this invention.

COMPARATIVE EXAMPLES

The following examples serve to illustrate and not limit this invention.

Example 1

In a series of runs, a catalyst (Catalyst A) comprising 0.3 wt % Pd on silica-alumina (IEP=6.95) mixed about 20% alumina binder (total alumina content equals 40.5 wt %) was evaluated for the conversion of 600N slack wax which contained an 85 wt % wax. The slack wax was first hydrotreated over KF-840 at 345° C., 1000 psig hydrogen, 1500 scf/B and 0.7 v/v/hr. The hydrotreated feed was then contacted with Catalyst A at 1000 psig $H_2$, 2500 scf/bbl at the temperature and space velocity shown in Table 1.

Following this treatment, the waxy hydroisomerized product was solvent dewaxed using a blend of MEK/MIBK (25/75 v/v) at a ratio of 4:1 solvent to isomerate at a filter temperature of −24° C. and the dewaxed oil was found to have the properties also shown in Table 1. The residual wax content of the waxy isomerate had been reduced from 85 wt % to 50–30 wt % for the 16–31% conversion. The VI of the dewaxed oil product was very good, ranging from about 145 to about 146.

TABLE 1

FEED WAX CONTENT 85%

| | Isomerization Condition | | | 370° C.+ | Dewaxed Oil Properties | | |
|---|---|---|---|---|---|---|---|
| Run | Temp., ° C. | LH-SV v/v/hr | Conversion to 370° C.- | Residual Wax Content, wt % | Viscosity at 40° C. | cSt at 100° C. | VI |
| 1 | 310 | 1.0 | 30.9 | 29.9 | 25.75 | 5.310 | 144.6 |
| 2 | 300 | 1.0 | 17.7 | 50.4 | 28.14 | 5.640 | 145.5 |

TABLE 1-continued

FEED WAX CONTENT 85%

| | Isomerization Condition | | | 370° C.+ | Dewaxed Oil Properties | | |
|---|---|---|---|---|---|---|---|
| Run | Temp., ° C. | LH-SV v/v/hr | Conversion to 370° C.- | Residual Wax Content, wt % | Viscosity at 40° C. | cSt at 100° C. | VI |
| 3 | 306 | 1.5 | 16.4 | 53.2 | 28.36 | 5.680 | 145.7 |
| 4 | 310 | 1.5 | 17.8 | 47.7 | 27.23 | 5.520 | 145.6 |

Comparative Example 2

In this Comparative Example, a catalyst (Catalyst B) consisting of 15.2 wt % $CoMoO_3$ on silica alumina (alumina content 84.5 wt %, IEP=6.9) was evaluated in a series of runs for the conversion of a 600N slack wax which contained 83 wt % wax. The slack wax was hydrotreated over KF-840 at 345° C., 1,000 psig $H_2$, 1500 scf/bbl, and 0.7 v/v/hr as in Example 1. The hydrotreated feed was then contacted with Catalyst B with 1,000 psig $H_2$, 2500 scf/bbl, and at the temperature and space velocity shown in Table 2.

The 370° C.+ DWO product was solvent dewaxed as in Example 1, analyzed and found to have the properties also shown in Table 2.

TABLE 2

FEED WAX CONTENT 83%

| | Isomerization Condition | | | 370° C.+ | Dewaxed Oil Properties | | |
|---|---|---|---|---|---|---|---|
| Run | Temp., ° C. | LH-SV v/v/hr | Conversion to 370° C.- | Residual Wax Content, wt % | Viscosity at 40° C. | cSt at 100° C. | VI |
| 5 | 355 | 1.0 | 17.7 | 60.13 | 27.722 | 5.638 | 148.3 |
| 6 | 355 | | 23.8 | 56.31 | 25.321 | 5.284 | 147.4 |
| 7 | 365 | | 31.9 | 46.10 | 32.798 | 5.015 | 145.3 |
| 8 | 370 | | 39.5 | 41.44 | 21.697 | 4.740 | 145.7 |

As can be seen, although the product VI was excellent the yield of product was very poor.

Example 3

A catalyst (Catalyst C) comprising 0.3 wt % Pd on silica-alumina (alumina content of the silica-alumina was 39.2 wt %, IEP=5.31, pore volume ($H_2O$) of 0.54 and a surface area of 416 $m^2$/gms) was evaluated in a series of runs for the conversion of a 600N slack wax which contained 85 wt % wax. The slack wax hydrotreated over KF-840 at 345° C., 1000 psig $H_2$, 1500 scf/bbl and 0.7 v/v/hr as in Example 1.

The hydrotreated feed was then contacted with Catalyst C at 1000 psig $H_2$, 2500 scf/bbl, and the temperature and space velocity shown in Table 3. Following such treatment the product solvent was dewaxed as in Example 1 and analyzed and the DWO had the properties shown in Table 3. The residual wax content of the isomerate was good at 30–37 for the 24.6–31.4% conversion achieved. The VI of the DWO product was excellent at 146–147.

TABLE 3

FEED WAX CONTENT 85%

| | Isomerization Condition | | | 370° C.+ | Dewaxed Oil Properties | | |
|---|---|---|---|---|---|---|---|
| Run | Temp., ° C. | LH-SV v/v/hr | Conversion to 370° C.- | Residual Wax Content, wt % | Viscosity at 40° C. | cSt at 100° C. | VI |
| 7 | 310 | 1.3 | 31.4 | 29.8 | 24.2 | 5.117 | 146 |
| 8 | 310 | 1.3 | 29.4 | 31.8 | 24.4 | 5.137 | 146 |
| 9 | 310 | 1.3 | 28.2 | 33.2 | 24.7 | 5.186 | 146 |
| 10 | 310 | 1.3 | 29.4 | 32.2 | 25.0 | 5.231 | 146 |
| 11 | 307 | 1.3 | 24.9 | 37.1 | 25.7 | 5.327 | 147 |
| 12 | 310 | 1.3 | 24.6 | 37.7 | 26.0 | 5.376 | 147 |

Example 4

A catalyst (Catalyst D) comprising 0.3 wt % Pt. on silica-alumina (alumina content of the silica alumina was 45 wt %) which was modified with 4 wt % yttria and having an isoelectric point of 6.08 before Pt loading, was evaluated for the conversion of a 600N slack wax which contained 85 wt % wax. The slack wax was first hydrotreated over Ni/Mo on alumina KF-840 at 345° C., 1000 psig $H_2$, 1500 scf/bbl and 0.7 v/v/hr.

The hydrotreated feed was then contacted in a series of runs with Catalyst D at 1000 psig $H_2$, 2500 scf/bbl, and the temperature and space velocity shown in Table 4. Following such treatment the product was analyzed and the DWO led the properties shown in Table 4. The residual wax content of the 370° C.+ isomerate was good at 46–31 for the 18–34.5% conversion achieved. The VI of the DWO product was outstanding at about 149.

TABLE 4

FEED WAX CONTENT 85%

| | Isomerization Condition | | | 370° C.+ | Dewaxed Oil Properties | | |
|---|---|---|---|---|---|---|---|
| Run | Temp., ° C. | LH-SV v/v/hr | Conversion to 370° C.- | Residual Wax Content, wt % | Viscosity at 40° C. | cSt at 100° C. | VI |
| 13 | 340 | 1.0 | 24.7 | 34.4 | 25.83 | 5.380 | 148.9 |
| 14 | 340 | 1.0 | 34.5 | 31.0 | 25.24 | 5.300 | 149.2 |
| 15 | 330 | 1.0 | 18.4 | 46.3 | 27.57 | 5.630 | 149.2 |

What is claimed is:

1. A method of producing a lube oil basestock from a waxy feed which comprises: contacting the waxy feed with an isomerization catalyst under catalytic isomerization conditions wherein the isomerization catalyst comprises at least one of Pt and Pd and a silica-alumina support, said silica-alumina having a pore volume of less than 0.99 ml/gm ($H_2O$), an alumina content of between about 35 to 55 wt % based on silica-alumina and an isoelectric point of from 4.5 to 6.5 to provide a lube basestock; and thereafter solvent dewaxing the basestock.

2. A method for producing a lube basestock of high VI from a waxy feed comprising: contacting the waxy feed under catalytic isomerization conditions with a catalyst comprising at least one of Pt and Pd and a silica-alumina support, the silica-alumina support having from about 35 to 55 wt % alumina based on silica-alumina, an isoelectric point of from 4.5 to 6.5 and a pore volume of less than 0.99 ml/gm ($H_2O$) to produce an isomerate; separating the isomerate into as least a lube fraction; and solvent dewaxing the lube fraction to provide a lube basestock.

3. The method of claims 1 or 2 wherein the pore volume is between 0.40 ml/gm ($H_2O$) and 0.99 ml/gm ($H_2O$).

4. The method of claims 1 or 2, further comprising isolating a wax from the solvent dewaxing step.

5. The method of claim 4 further comprising recycling the wax into the waxy feed.

6. A method of producing a lube oil basestock from a waxy feed which comprises contacting the waxy feed with an isomerization catalyst under catalytic isomerization conditions wherein the isomerization catalyst comprises at least one of Pt and Pd and a silica-alumina support, said silica-alumina having a pore volume of less than 0.99 ml/gm ($H_2O$), an alumina content of between about 35 to 55 wt % based on silica-alumina wherein the silica-alumina is modified with a rare earth oxide or yttria or boria or magnesia and has an isoelectric point greater than but no more than 2 points greater than that of the base silica-alumina, to provide a lube basestock; and thereafter solvent dewaxing the basestock.

7. A method for producing a lube basestock of high VI comprising: contacting a waxy feed under hydroisomerization conditions with a catalyst comprising at least one of Pt and Pd and a silica-alumina support, the silica-alumina support having from about 35 to 55 wt % alumina based on silica-alumina, wherein the silica-alumina is modified with a rare earth oxide or yttria or boria or magnesia and has an isoelectric point greater than but no more than 2 points greater than that of the base silica-alumina, to provide a lube basestock; and thereafter solvent dewaxing the basestock.

8. The method of claims 6 or 7 wherein the pore volume is between 0.40 ml/gm ($H_2O$) and less than 0.99 ml/gm ($H_2O$).

9. The method of claims 6 or 7 wherein a wax is isolated from the solvent dewaxing step.

10. The method of claim 9 wherein the wax is recycled in the feed.

* * * * *